United States Patent [19]

Nijman et al.

[11] 4,085,497

[45] Apr. 25, 1978

[54] TERMINATION APPARATUS FOR ELECTRICAL CONNECTORS

[75] Inventors: John Peter Nijman, West Hill; Terence Neville Tompkins, Newmarket, both of Canada

[73] Assignee: Bunker Ramo Corporation, Oak Brook, Ill.

[21] Appl. No.: 735,956

[22] Filed: Oct. 27, 1976

[51] Int. Cl.[2] ..... H01R 43/04

[52] U.S. Cl. ..... 29/566.3; 29/267; 29/749; 29/751; 29/753

[58] Field of Search ..... 29/566.3, 566.4, 749, 29/750–754, 267

[56] References Cited

U.S. PATENT DOCUMENTS

| | | | |
|---|---|---|---|
| 3,866,293 | 2/1975 | Nijman | 29/749 |
| 3,885,287 | 5/1975 | Long et al. | 29/749 X |
| 3,935,628 | 2/1976 | Tucci | 29/749 |
| 3,938,246 | 2/1976 | Over et al. | 29/628 |
| 3,952,392 | 4/1976 | Nijman et al. | 29/566.3 |
| 3,968,555 | 7/1976 | Holt | 29/749 |

*Primary Examiner*—Carl E. Hall

*Attorney, Agent, or Firm*—William Lohff; F. M. Arbuckle

[57] ABSTRACT

A termination apparatus for electrical connectors, which includes an improved apparatus for applying operating forces from an apparatus operator to rotatable insertion arms, is provided for use in inserting a plurality of insulated conductors into respective insulation piercing contact portions of an electrical connector. The disclosed apparatus includes a frame, a removable support structure for a connector, which aligns the insulated conductors adjacent respective insulation-piercing contact portions of the connector, a pair of oppositely disposed insertion tools that are rotatably mounted on the frame for movement toward and away from each other and that carry insertion tools for inserting the insulated conductors into the connector, and an assembly that more effectively applies and distributes operating forces to the insertion arms during a termination cycle. The disclosed assembly for applying and distributing operating forces includes a removable and independently positionable handle structure that is releasably secured to and imparts rotational motion to a rotatable camming shaft carried by the frame. A spiral groove is provided in the rotatably camming shaft which engages and defines a predetermined path of travel for camming rollers carried by each of the insertion arms.

21 Claims, 6 Drawing Figures

FIG. 1
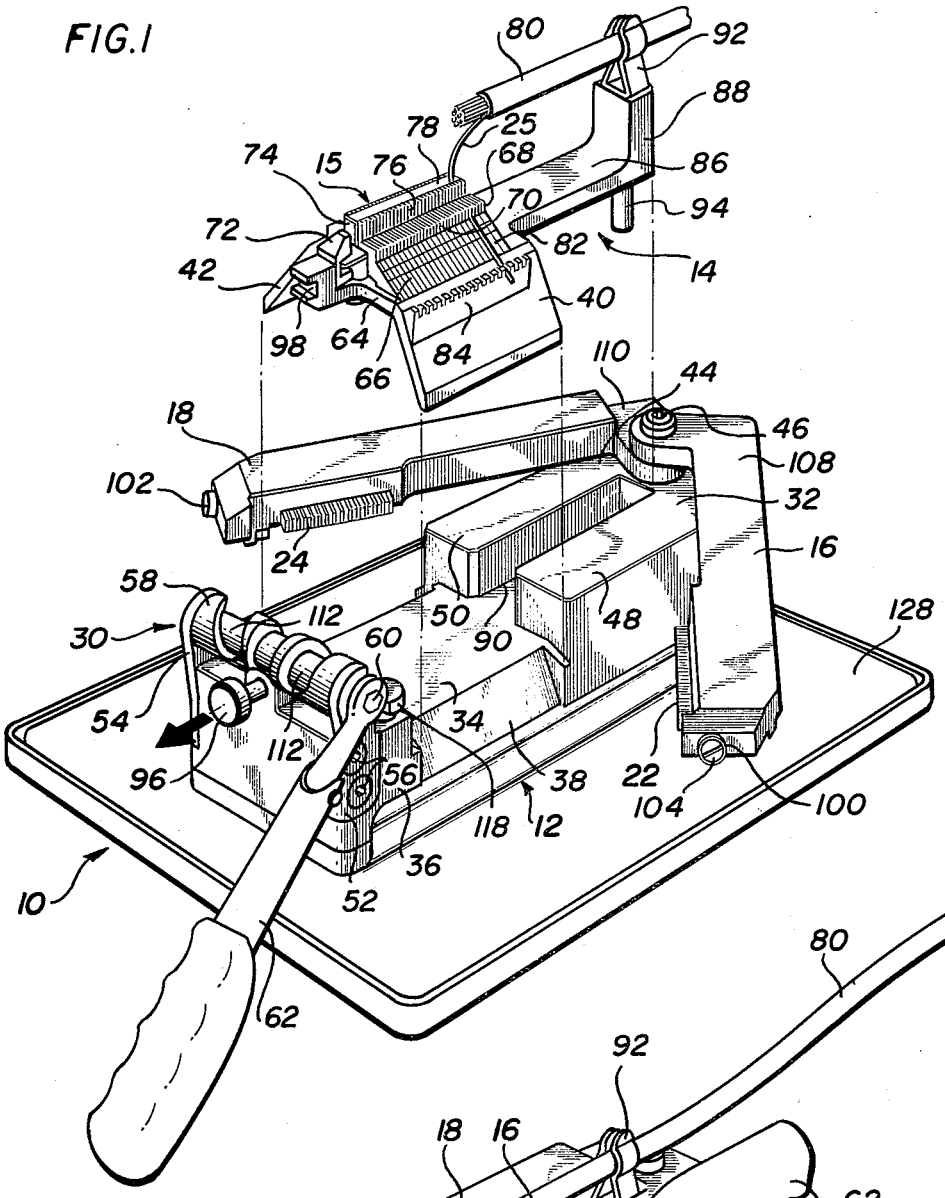
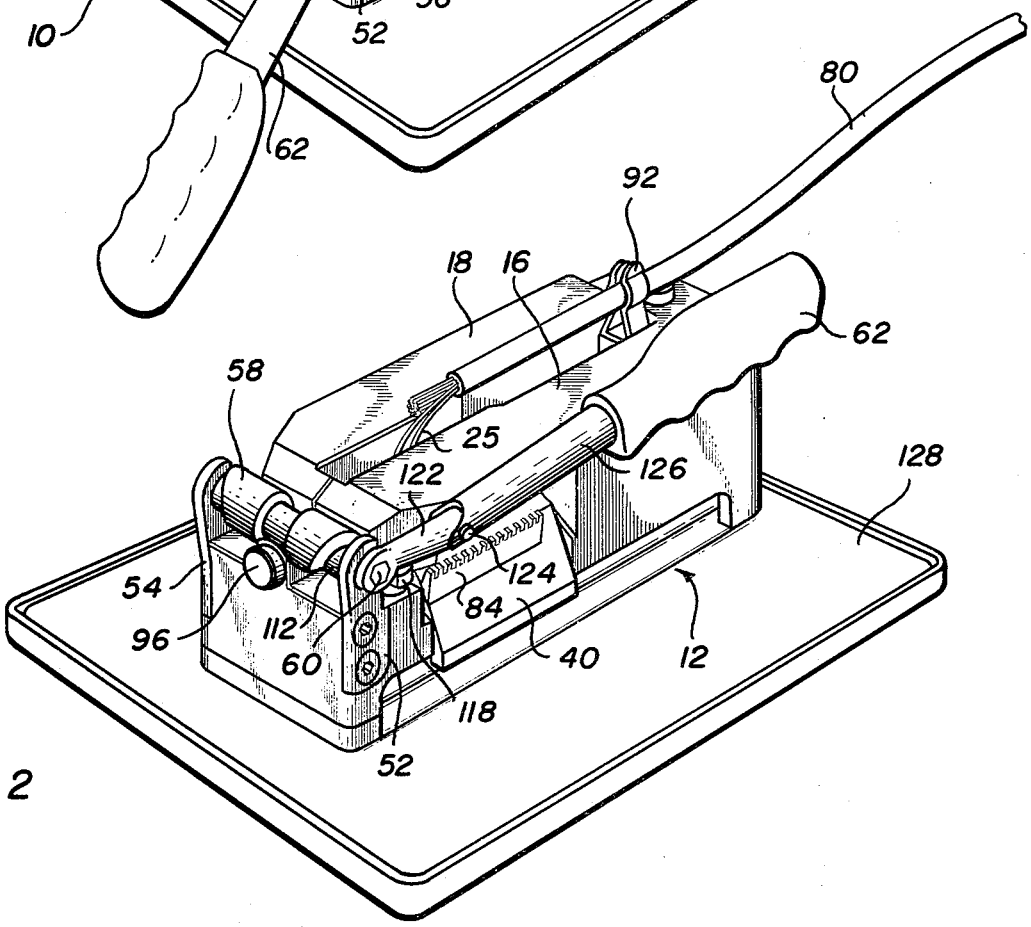
FIG. 2

TERMINATION APPARATUS FOR ELECTRICAL CONNECTORS

BACKGROUND OF THE INVENTION

This invention relates to an apparatus for terminating a plurality of insulated conductors by engaging and pressing such conductors into respective insulation-piercing contact portions of an electrical connector, and more particularly to a more simplified, yet reliable, conductor termination apparatus that includes structure for reducing and more efficiently distributing the operating forces necessary to achieve satisfactory conductor insertion and termination into an electrical connector.

Prior art termination tools generally include a frame or base structure, which carries a support assembly for an electrical connector, and a pair of oppositely disposed, rotatable insertion arms, each of which are designed to carry multi-blade conductor insertion tools that are used to engage and press free-ended insulated conductors into respective insulation-piercing contact portions of an electrical connector carried by the support structure. The operating force required to accomplish satisfactory conductor termination in such termination tools is generally quite high, and is most frequently applied, for example, by means of separate handles which are individually attached to each of the insertion arms, swing in a substantially horizontal plane, and engage and cam about a fulcrum means carried by the frame of the termination tool. As the handles, and therefore the insertion arms themselves, are brought together during operation of the termination apparatus, the handles first engage and then cam about the fulcrum means carried by the frame, and in this way cause the force applied to the handles by a tool operator to be rapidly translated into insertion and termination forces at the insertion arms.

Although this manner of applying operating force from a termination tool operator to the insertion arms of the tool has proved satisfactory in most applications, some operators have experienced difficulties in applying sufficient force to the oppositely disposed handles to effect termination. This has resulted in large part, because the handles, like the insertion arms, are rotatable in a substantially horizontal plane, and thus require an operator to use his hands, arms and shoulders in an unnatural scissorslike motion to apply operating forces sufficient to cause termination. In addition, the handle structures of such prior art termination tools are permanently fixed in relatively awkward positions for efficient application of operating forces and cannot be adjusted or moved to more advantageous positions to suit the particular needs of a particular operator for any given termination application.

It has also been found to be desirable in the operation of prior art termination tools to cause a slight but continuous downward pressure to be applied to the insertion arms of the termination tool during the termination operation to insure, among other things, that relatively close contact is maintained between the lower edge of multi-blade insertion tools, carried by the insertion arms, and the upper cutting edge of the electrical connector support assembly. In order to accomplish this desired application of downward pressure on the insertion arms, relatively complex spring-loaded assemblies, which are carried by the frame, are provided, in some instances, to exert the required downward pressure on the insertion arms, while, in other instances, the downward pressure is created by the combination of such spring mechanisms and a toggle-cam assembly, or by the engagement of a camming surface present on the insertion arms and a conical pin carried by the frame. In each instance, however, the structure used to achieve the required downward pressure on the insertion arms in the prior art termination tools undesirably adds a measure of cost and additional complexity to the termination tool.

As a consequence of these and various other difficulties which have been experienced with various prior art termination tools, a need has developed for a more simplified, yet reliable, termination apparatus that more readily permits the application of operating forces adequate to effect satisfactory conductor insertion and termination in an electrical connector, while at the same time, permitting the application of sufficient downward pressure on the insertion arms, without the use of complex components, to insure close contact during termination between the multi-blade insertion tools carried by the arms and the support assembly for the electrical connector.

SUMMARY OF THE INVENTION

A primary object of the present invention, therefore, is to provide a new, simplified, and improved termination apparatus for terminating a plurality of free-ended insulated conductors in respective insulation-piercing portions of an electrical connector.

A more specific object of the invention is to provide a termination apparatus in which operating forces sufficient to accomplish satisfactory insertion and termination can more easily and efficiently be applied by operators of such apparatus.

Another object of the present invention is to provide a termination apparatus in which operating forces applied by an operator of such apparatus are distributed in such a way as to permit the uniform application of downward forces on the insertion arms of such apparatus sufficient to maintain close contact between the multi-blade insertion tools carried by the arms and the electrical connector support assembly.

A further object of the present invention is to provide a termination apparatus in which required operating force can be applied by an operator to a single handle, and in a flexible manner most suited for his particular needs by adjusting, where necessary, both the operating position of the handle and the angle at which operating force is applied.

Still another object of the present invention is to provide a termination apparatus which includes an electrical connector support assembly that is releasably engageable with the frame of such termination apparatus so that one or more connectors can be dressed accordingly to a wiring schedule at a point remote from the termination apparatus, checked for errors in dressing and then terminated at a later time.

According to the present invention, a more simplified, yet reliable, termination apparatus is provided for efficiently terminating a series of insulated electrical conductors in respective insulation-piercing contact portions of an electrical connector. Operating forces applied by a termination apparatus operator are translated, through a rotatable camming assembly and cooperating camming rollers that are mounted on a pair of insertion arms, into separate vertical cutting and horizontal insertion force components that cause a more efficient cutting and insertion of the insulated conductors into respective insulation-piercing contact portions of the connector. A removable and independently positionable handle assembly is provided to apply operating force from the termination apparatus operator to the rotatable camming assembly. Since the handle assembly is independently positionable, the manner and angle at which operating force is applied to the rotatable camming assembly can be adjusted depending upon the operator's needs and the particular termination conditions and application involved.

The rotatable camming assembly includes a rotatable camming shaft that is mounted on the termination apparatus frame and has a spiral recess that cooperatively engages and defines a path of travel for a pair of cam rollers carried on the ends of each of swingable insertion arms.

Operating forces that are applied to the rotatable camming shaft by the multi-positionable handle assembly are translated by the cooperative action of the rotatable camming shaft and cam rollers into vertical force components sufficient to maintain a desired close contact and high cutting efficiency between insertion tools carried by the insertion arms and the cutting edges of a connector support assembly, and into horizontal force components sufficient to insure complete and satisfactory insertion of the insulated conductors into an electrical connector. The handle assembly is preferably constructed to provide a positive indication to an operator that a sufficient operating force has been applied to the insertion arms to effect complete and satisfactory insertion of the insulated conductors into the electrical connector.

BRIEF DESCRIPTION OF THE DRAWINGS

The above-mentioned and various other objects, features and advantages of the present invention will become apparent from the detailed description of the presently preferred embodiments of the invention as set forth below and from the accompanying drawings, of which:

FIG. 1 is a pictorial representation of one embodiment of the conductor termination apparatus of this invention with the connector support assembly in a released position;

FIG. 2 is a pictorial view of the conductor termination apparatus shown in FIG. 1 with the connector support assembly securely locked in operating position on the termination apparatus frame, and the insertion arms and handle structure in the position they occupy near the end of the termination cycle;

DESCRIPTION OF THE PREFERRED EMBODIMENTS

Figure 3:
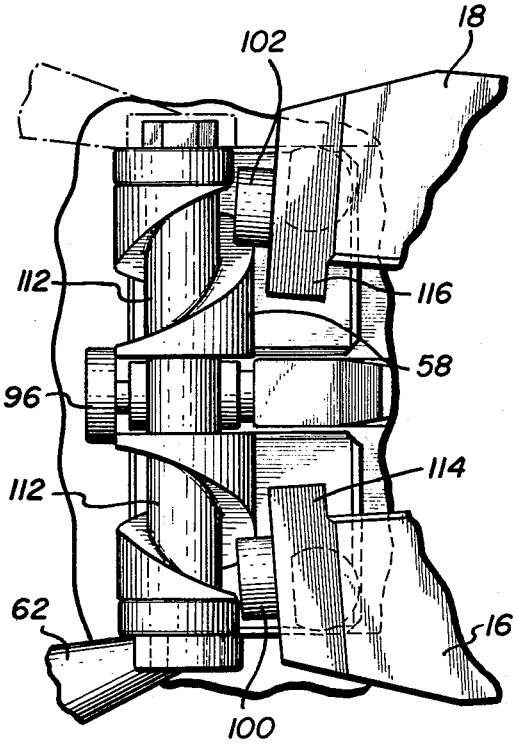
FIGS. 3–5 are fragmentary top views of the rotatable camming shaft and associated cam roller mechanism used for applying operating force to the termination apparatus insertion arms showing the relative operating relationships between the cam rollers and the rotatable shaft at various points in the termination cycle.

One embodiment of the terminating apparatus of the present invention, as generally illustrated at 10 in FIG. 1, comprises a frame structure 12, which carries an electrical connector support and conductor alignment mechanism 14, which is designed to position and support an electrical connector 15, two pivotal insertion arms 16 and 18, which carry multi-blade insertion tools 22 and 24 that engage and press respective insulated conductors 25 into appropriate insulation-piercing contact portions of connector 15, and an operating force application assembly, shown generally at 30, that translates operating forces applied by an apparatus operator into insertion forces sufficient to insert and terminate a plurality of free-ended conductors 25 into respective insulation-piercing contact portions of an electrical connector 15.

Frame 12, as illustrated in FIGS. 1 and 2, includes in the area of the connector support and conductor alignment mechanism 14, upstanding generally U-shaped rear wall portion 32, a base portion 34 and an upstanding forward wall portion 36, which together serve to support and position the connector support and conductor alignment mechanism 14 longitudinally on the frame 12. The base portion 34, upon which the connector support and conductor alignment mechanism 14 rests, has oppositely disposed tapered side walls 38 which accommodate the angularly disposed and downwardly extending walls 40 and 42 of the connector support and conductor alignment mechanism 14 after it has been placed in position for the termination to commence. The upstanding generally U-shaped rear wall portion 32 of the frame includes a rear portion 44, upon which insertion arms 16 and 18 are rotatably mounted by means of pin 46, and two oppositely disposed side wall portions 48 and 50, which provide support for the insertion arms 16 and 18 as they are rotated into their operating positions.

The upstanding forward wall portion 36 of the frame is provided with two spaced-apart rail portions 52 and 54 which are either secured at opposite sides of the forward wall portions 36 by means of fasteners 56, or are preferably formed as an integral part of the forward wall portion 36 structure itself. The rail portions 52 and 54 serve as a support assembly for a rotatable camming member 58 whose opposite ends extend through and are journaled in bearings (not shown) formed in rail portions 52 and 54. Each of the terminal ends of the rotatable camming member 58 are hexagonally shaped, as indicated at 60, and are designed to be releasably engaged by at least one, and if necessary two, handles 62 which are used to impart operating force to the rotatable camming member.

As shown in FIG. 1, the connector support and conductor alignment mechanism 14 includes a base 64 from which the downwardly extending angular portions 40 and 42 depend. The base 64 also carries a pair of generally upstanding comb elements 66 which extend above the upper surface of the base 64. Each of the upstanding comb elements includes a plurality of spaced comb teeth 68 which define a series of separate conductor receiving slots 70 that are spaced in a manner corresponding to the spacing of the insulation-piercing contact portions of an electrical connector 15. The connector 15 is slid into the comb structure between comb elements 66, from the rear as shown in FIG. 1, so that its forward end rests against an integral end-stop (not shown) which extends outwardly from the inside surface of upwardly projecting base extension 72 and serves to restrict the movement of connector 15 and properly align the conductor receiving slots 70 of the comb elements with corresponding insulation-piercing contact portions of connector 15.

As noted above, an electrical connector 15 is carried on the upper surface of base 64 and includes a forward end 74, a plurality of contact carrying slots 76 spaced in parallel rows on each side of the connector, and a longitudinal slot 78 that extends along the length of the connector and communicates with slots 76.

The comb structure, as described, for example, in U.S. Pat. No. 3,952,392 and U.S. Pat. No. 4,038,745 is desirably constructed as one-piece structure, and according to the present invention is preferably made either as an integral part of frame 12 or, as shown in the drawings, as a separate releasable member of the frame. Conductor receiving slots 70 of the comb elements 66 are adapted to receive individual conductors 25 of the cable 80 after such conductors have been dressed through the corresponding connector slots 78 of connector 15 in accordance with the color-coded wiring schedule indicia 82 that are physically imposed on angular portions 40 and 42. Each of the conductor receiving slots 70 in comb elements 66 are provided with a sharp cutting edge (not shown) at the rear upper portion of the slots directly adjacent the respective insulation-piercing contact portions of connector 15. These cutting edges are designed to cooperate with the lower edge of the multi-blade insertion tools 22 and 24 carried by insertion arms 16 and 18 respectively to sever the conductors immediately prior to insertion.

As shown in FIG. 1, the downwardly extending angular portions 40 and 42 of the base 64 also carry slotted conductor holding combs 84 which extend longitudinally and secure respective ends of the insulated conductors 25 after they have been dressed into connector slots 76 and the conductor receiving slots 70 of the individual comb elements 66. After cutting and termination take place, conductor holding combs 84 also serve as a means for holding and easily collecting waste ends of the insulated conductors 25 as a bundle rather than as individual pieces. Although holding combs 84 can be made as individual molded plastic units that are secured to walls 40 and 42, coil springs or similar mechanisms can also be used in place of the holding combs to secure the conductors during termination.

The base 64 of the connector support and conductor alignment mechanism 14 includes a rear base extension 86 having an arcuate end 88 which is complementary to and fits within the opening 90 formed in the upstanding U-shaped portion 32 of the termination apparatus frame. The rear base extension 86 has a cable clamp 92 for receiving and holding a multi-conductor calbe 80, which can either be releasably secured to arcuate end 88 or formed as an integral molded part of end 88. Pin 94, which extends downwardly from the rear base extension 86 and is insertable in a recess (not shown) formed in the base portion 34 of the frame, is provided to orient and permit the easy removal of the connector support and conductor alignment mechanism 14 from frame 12.

When it is desired to lock the connector support and conductor alignment mechanism 14 into its operating position on base 34, plunger 96, which is inwardly biased by means of a spring, is first outwardly extended as shown in FIG. 1. Then the connector support and conductor alignment mechanism is properly oriented on the base 34, after which plunger 96 is released into its inwardly biased position so that it can extend into the recess 98 formed in forward base extension 72 and securely lock the connector support and conductor alignment on the base. In order to insure that the connector support and connector alignment mechanism is properly oriented on base 34, a second downwardly extending pin, similar to pin 94, can be provided at a second point on the lower surface of base 64, so that it, like pin 94, can also be placed into a complementary recess formed in base member 34, thereby positioning the connector support and conductor alignment mechanism 14 at two separate points on base 34. When it is desired to remove the connector support and conductor alignment mechanism 14 from base 34, plunger 96 is merely extended outwardly as shown in FIG. 1 until it clears base extension 72, and the entire mechanism is lifted away from base 34.

Although it often is desirable to have a releasable connector support and conductor alignment mechanism so that more than one connector can be dressed at a point remote from the termination apparatus and then terminated at a later time, the connector support and conductor alignment mechanism 14 can be made as an integral non-removable part of frame 12. When the terminating apparatus is intended for use in terminating connectors in the field, rather than in a factory, for example, it is often more desirable from a cost and simplicity of parts standpoint to make the connector support and conductor alignment mechanism an integral part of the terminating apparatus frame. This can be accomplished, of course, merely by die casting the entire comb structure (with the exception of the slotted sections 68 and 70, which are preferably machined and mounted separated) as a single, integral part of frame 12.

As noted above, the comb structure, like the frame 12 of the terminating apparatus of this invention, can be die cast or machined from solid metal, or, in some instances, can be molded from plastic materials, such as glass-filled thermoplastics. In addition, and although it is not preferred, the comb structure can, if desired, also be constructed from a plurality of individual members which are secured together by fasteners and the like to form a single unitary structure. It is desirable, of course, in nearly all instances that the cutting edges in the rear upper portion of slots 70 of the comb structure be fabricated from metal to insure efficient and effective cutting of the individual conductors.

During termination of a plurality of insulated conductors with a termination apparatus, care should be taken to insure complete insertion of the insulated conductors into the insulationpiercing contact portions of an electrical connector because, if the insertion of one or more conductors is incomplete, the electrical connection obtained is unsatisfactory. At the same time, the application of excessive transverse insertion forces during termination could damage the electrical connector, and is equally undesirable.

Moreover, if downward forces are not applied to the insertion arms 16 and 18 sufficient to maintain close contact between the lower edge of insertion tools 22 and 24 and the upper cutting edges of the conductor receiving slots 70, the conductors are not cleanly and efficiently cut prior to insertion into the connector. At the same time, if excessive downward forces are applied to the insertion arms 16 and 18 during termination, the insertion tools 22 and 24 could damage the uppermost surfaces of the conductor receiving slots 70.

Figure 6:
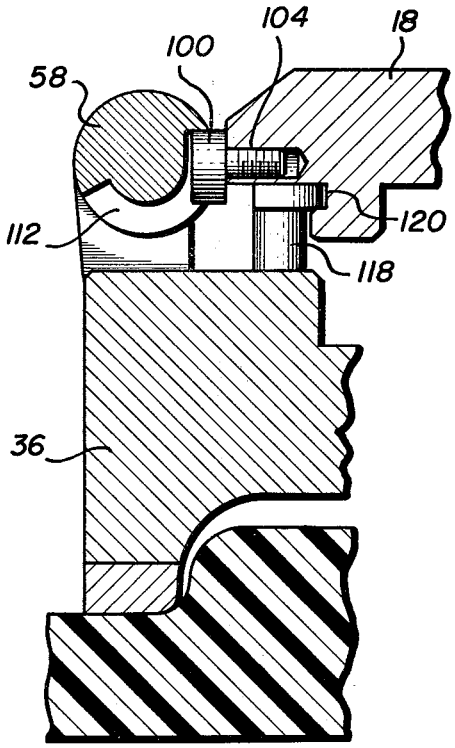
FIG. 6 is a sectional view of the termination apparatus taken along line 6—6 of FIG. 5 showing the rotatable camming shaft and cooperating roller mechanism in section.

As a consequence of these and various other considerations, care should be taken to insure that operating forces are applied and then distributed, as vertical and horizontal force components, in the most advantageous manner during the termination cycle. In the termination apparatus illustrated in FIGS. 1 and 2, for example, operating forces that are applied to handle 62 are translated by the cooperative action of the rotatable camming member 58 and cam rollers 100 and 102 into vertical force components sufficient to maintain the desired close contact and cutting efficiency between insertion tools 22 and 24 and the upper cutting edges of conductor receiving slots 70, and into horizontal force components sufficient to insure complete insertion of the insulated conductors into the electrical connector 15. Cam rollers 100 and 102 as shown in FIGS. 1 and 6 are rotatably mounted on the ends of the insertion arms 16 and 18 by means of fasteners 104, and are adapted to be received in and to cooperate with the spiral grooves 106 formed in rotatable camming member 58.

The insertion arms 16 and 18 include laterally extending recessed ends 108 and 110, which are rotatably mounted to the rear portion 44 of the U-shaped rear wall 32 of the frame by means of pin 46. Each of the ends 108 and 110 are desirably recessed by an amount approximately one-half the thickness of its respective insertion arm so that insertion arms 16 and 18 can be made to rotate in a common plane. As shown in FIG. 3, the arms 16 and 18 are rotated toward each other until cam rollers 100 and 102 are brought into cooperative engagement with and begin to move in the path defined by spiral recess or grooves 112 formed in the rotatable camming member 58. At this initial point of contact between grooves 112 and cam rollers 100 and 102, handle 62 is in its lowermost position. As the handle 62 is rotated in a vertical plane, however, approximately 45° to 50° from its lowermost position (FIGS. 1 and 3) until it is perpendicular to base 34 (FIG. 4), and then another 45° until it is substantially parallel to base 34 (FIG. 5), operating forces applied to the handle 62 are translated into vertical cutting or severing forces and horizontal insertion forces on insertion arms 16 and 18 by the cooperative action of cam rollers 100 and 102 and the spiral grooves 112 of rotatable camming member 58.

Figure 4:
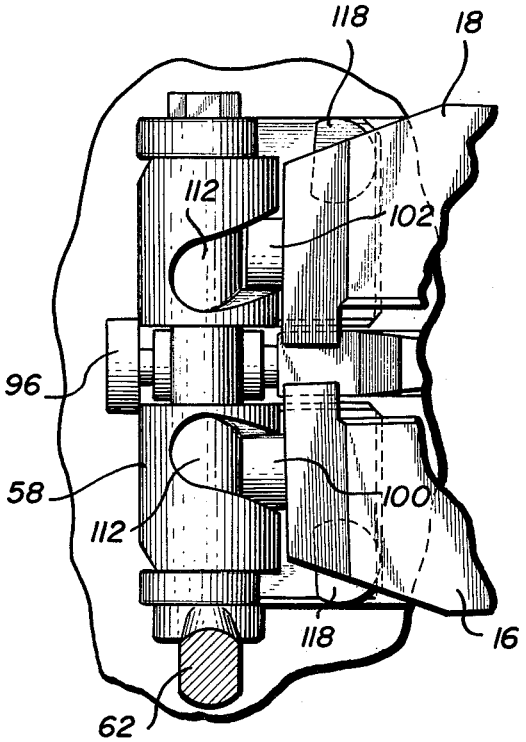
Figure 5:
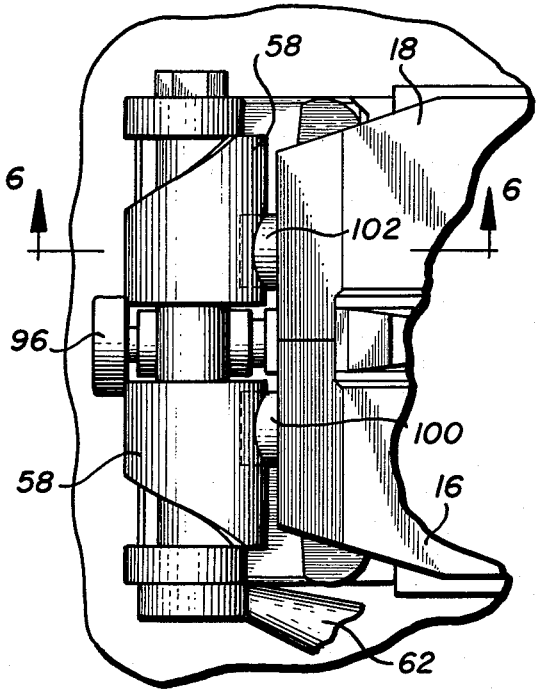

As can be seen, for example, from FIGS. 3–5, the spiral grooves 106 are essentially S-shaped so that a greater angular relationship between the axis of grooves 106 and the axis of cam rollers 100 and 102 exits during the initial (FIG. 3) and intermediate (FIG. 4) stages of the termination sequence than during the final stage (FIG. 5) of the termination sequence. During the initial and intermediate stages of the termination sequence (FIGS. 3 and 4), when conductors 25 are being cut by the cooperative action of insertion tools 22 and 24 and the upper cutting edges of the conductor receiving slots 70, the greater angular relationship results in a minimal horizontal force component and a vertical force component sufficient to maintain the desired close contact and effective cutting action between insertion tools 22 and 24 and the upper cutting edges of conductor receiving slots 70. During the final stage of the termination sequence (FIG. 5), however, when the conductors 25 are actually inserted into respective insulation-piercing contact portions of the electrical connector 15, the lesser angular relationship between the axis of grooves 106 and cam rollers 100 and 102 results in a far greater horizontal force component being applied to the insertion arms 16 and 18 to insure complete and satisfactory insertion of conductors 25 into connector 15. Thus, by proper selection of an appropriate configuration for spiral grooves 106 a proper balance can be maintained between vertical force components sufficient to permit efficient cutting of the conductors, and horizontal force components sufficient to insure complete and satisfactory conductor insertion.

In order to prevent the application of excessive force across the connector 15 during the termination cycle, extended portions 114 and 116 are provided on the ends of insertion arms 16 and 18 respectively to act as stop walls to prevent further movement of the insertion arms after the termination cycle has been completed. In addition, a pair of T-shaped pins 118, which extend above the upstanding forward wall portion 36 of frame 12 and which cooperate with slotted sections 120 (FIG. 6) formed in the lower end of each of the insertion arms 16 and 18 as the arms swing together, are desirably provided to limit any excessive upward or downward movement of the insertion arms during the termination cycle. Since significant frictional forces can be generated as the cam rollers 100 and 102 move through the path defined by spiral grooves 112, the cam rollers can be replaced, for example, with needle bearings to reduce the frictional forces, and thus, to reduce the operating forces on handle 62 as well.

In order to increase the versatility and adaptability of the termination apparatus to accommodate the particular needs of different operators, handle 62 is desirably designed to be removable from the hexagonally shaped shaft end 60 so that it can in effect act as a star-wrench and be positioned at varying angular points on shaft end 60. If the terminating apparatus is to be mounted on a work bench, for example, handle 62 can desirably be placed in a perpendicular relationship with the horizontal surface of the work bench just prior to termination to accommodate the most efficient application of operating force. If, on the other hand, an operator desires to use his or her body weight to assist in the application of operating force, handle 62 can be placed in a substantially parallel relationship with the work bench just prior to termination. Since handle 62 is removable, it can, in some cases, be placed in one position during a portion of the termination cycle, then removed and placed in a more advantageous position for the efficient application of operating force during another portion of the termination cycle. In addition, handles of differing lengths and structures can be used to apply operating force, and if desired, two handles can be placed on opposite sides of the rotatable camming member 58 to balance the manner in which operating force is applied to the termination apparatus.

Handles 62 are preferably constructed to provide a positive indication to an operator that a sufficient insertion force has been applied to the insertion arms to effect complete termination so that an operator will discontinue the application of operating force immediately after complete insertion has taken place and will not continue to apply excessive operating forces that might damage the connector. One desirable way to accomplish the positive indication that complete termination has taken place is through the use of torque responsive handles of the general type described in copending application Ser. No. 580,577. Handle 62, as shown in FIGS. 1 and 2, includes a torque lever 122 having a pivot pin 124 which connects the lever to a hollow handle 126. A compression spring (not shown) housed within the hollow handle 126 urges a bearing pin against a roller bearing which is disposed between the bearing pin and the end of torque lever 122. As operating force is applied to handle 62 and torque lever 122 during its engagement with shaft end 60 and insertion force is applied to the insertion arms 16 and 18, torque lever 122 develops a moment about pivot pin 124. With the application of increased force, the moment about pivot pin 124 increases, and in turn, increases the force applied to the roller bearing and the compression spring. As the operating force increases to the point at which the spring begins to compress, the roller bearing is moved to a point at which the torque lever 122 swings rapidly in an opposite direction so that it strikes the inner wall of the hollow handle 126. The resultant impact of the torque lever striking the inner wall of the hollow handle 126 generates a mechanical vibration in the handle which is felt by the operator and an audible click which is heard by the operator, each of which provides an immediate and positive indication that termination is complete.

By utilizing torque handles of the type described herein or in copending application Ser. No. 580,577, a predetermined insertion force can be applied to the insulated conductors, because a positive indication can be provided to the termination apparatus operator that adequate insertion forces have been applied to effect complete termination.

As discussed herein, the termination apparatus can be mounted on a work bench for factory use or mounted in a carrying case (the base portion of which is shown at 128 of FIGS. 1 and 2) for use in terminating electrical conductors in the field.

Although the present invention has been described by reference to particular embodiments thereof, it should be understood that various changes and modifications can be made to the particular embodiments described herein without departing from the spirit and scope of the invention as set forth in the following claims.

We claim:

1. An apparatus for terminating a plurality of insulated electrical conductors in respective insulation-piercing contact portions of an electrical connector, comprising:

a frame; means carried by the frame for supporting said connector and aligning said conductors adjacent respective insulation-piercing contact portions of said connector;

a pair of insertion arms rotatably mounted on said frame for movement toward respective sides of said connector, each of said arms carrying at least one insertion means for engaging and pressing respective insulated conductors into respective insulation-piercing contact portions of said connector; and actuator means responsive to a common applied force for simultaneously applying sufficient operating force to each of said insertion arms and for causing said insertion arms to simultaneously cut and insert said conductors into respective insulation-piercing contact portions of said connector.

2. The apparatus of claim 1 wherein said actuator means are responsive to an applied rotational force.

3. The apparatus of claim 1 wherein said operating force includes a horizontal component in the plane of said insertion arms, and a vertical component substantially perpendicular to the plane of said insertion arms.

4. The apparatus of claim 1 wherein said insertion means carried by said insertion arms comprise a plurality of insertion tools for engaging and pressing individual conductors into respective insulation-piercing contact portions of said electrical connector, each of said insertion tools including a lower edge which is cooperable with a cutting edge formed on said connector support and conductor alignment means to sever a corresponding insulated conductor immediately prior to insertion into the respective insulation-piercing contact portions of said connector, and wherein said actuator means for applying and translating operating force apply vertical forces on said insertion arms sufficient to maintain the lower edges of said insertion tools and the cooperable cutting edges of said conductor support and connector alignment means in contact with each other during the cutting of said conductors.

5. An apparatus for terminating a plurality of insulated electrical conductors in respective insulation-piercing contact portions of an electrical connector, comprising:

a frame;

means carried by the frame for supporting said connector and aligning said conductors adjacent respective insulation-piercing contact portions of said connector;

a pair of insertion arms rotatably mounted on said frame for movement toward respective sides of said connector, each of said arms carrying at least one insertion means for engaging and pressing respective insulated conductors into respective insulation-piercing contact portions of said connector; and actuator means responsive to an applied force directed along a plane substantially perpendicular to the plane of said insertion arms for simultaneously applying sufficient operating force to each of said insertion arms to cut and insert said conductors into respective insulation-piercing contact portions of said connector.

6. An apparatus for terminating a plurality of insulated electrical conductors in respective insulation-piercing contact portions of an electrical connector, comprising:

a frame; means carried by the frame for supporting said connector and aligning said conductors adjacent respective insulation-piercing contact portions of said connector;

a pair of insertion arms rotatably mounted on said frame for movement toward respective sides of said connector, each of said arms carrying at least one insertion means for engaging and pressing respective insulated conductors into respective insulation-piercing contact portions of said connector; and actuator means responsive to an applied force for simultaneously applying sufficient operating force to each of said insertion arms to cut and insert said conductors into respective insulation-piercing contact portions of said connector;

said operating force including a horizontal component in the plane of said insertion arms, and a vertical component substantially perpendicular to the plane of said insertion arms, wherein said vertical component is increased relative to said horizontal component during that portion of the termination cycle wherein said conductors are cut and decreased relative to said horizontal component during that portion of the termination cycle wherein said conductors are inserted into said contact portion.

7. An apparatus for terminating a plurality of insulated electrical conductors in respective insulation-piercing contact portions of an electrical connector, comprising:

a frame; means carried by the frame for supporting said connector and aligning said conductors adjacent respective insulation-piercing contact portions of said connector;

a pair of insertion arms rotatably mounted on said frame for movement toward respective sides of said connector, each of said arms carrying at least one insertion means for engaging and pressing respective insulated conductors into respective insulation-piercing contact portions of said connector;

actuator means responsive to an applied force for simultaneously applying sufficient operating force to each of said insertion arms to cut and insert said conductors into respective insulation-piercing contact portions of said connector wherein said actuator means for applying and translating operating force comprise camming means rotatably mounted on said frame for receiving and translating said operating forces applied thereto into insertion force components; and cam means mounted on said insertion arms and cooperatively associated with said camming means for receiving and transmitting said force components to said insertion arms.

8. The apparatus of claim 7 wherein said camming means comprise a rotatable shaft including respective terminal ends and a spiral recess formed therein for engaging and defining a path of travel for said cam means.

9. The apparatus of claim 8 wherein said means for applying and translating operating force include at least one handle secured to a terminal end of said rotatable shaft for receiving applied operating force and applying said force to said rotatable shaft.

10. The apparatus of claim 9 including indicator means responsive to the application of a predetermined insertion force to said insertion arms for signaling the completion of the terminating cycle by said apparatus.

11. The apparatus of claim 10 wherein said indicator means comprise a torque handle means secured to said rotary camming shaft for imparting rotary motion to said camming shaft and for generating a mechanical vibration to indicate completion of the termination cycle.

12. The apparatus of claim 11 wherein said torque handle means comprise:

a hollow tube;

a lever rotatably connected to the rotary camming shaft and including a first portion secured to said camming shaft, a second portion pivotally connected to said hollow tube and a third portion extending within said hollow tube and abutting one end of a roller bearing;

bias means in said hollow tube urging a bearing pin toward the opposite end of the roller bearing; and a handle portion for receiving the application of operating force, the application of a predetermined torque to said lever causing said bias means to compress sufficiently through the cooperative action of said roller bearing and bearing pin to cause the third portion of said lever to strike the inner surface of said hollow tube.

13. The apparatus of claim 9 wherein said handle is releasably secured to a terminal end of said rotatable shaft and is independently positionable at differing points about the axis of rotation of said shaft.

14. An apparatus for terminating a plurality of insulated electrical conductors in respective insulation-piercing contact portions of an electrical connector, comprising:

a frame; means carried by the frame for supporting said connector and aligning said conductors adjacent respective insulation-piercing contact portions of said connector;

a pair of insertion arms rotatably mounted on said frame for movement toward respective sides of said connector, each of said arms carrying at least one insertion means for engaging and pressing respective insulated conductors into respective insulation-piercing contact portions of said connector;

actuator means responsive to an applied force for simultaneously applying sufficient operating force to each of said insertion arms to cut and insert said conductors into respective insulation-piercing contact portions of said connector;

said means for applying and translating operating force comprising camming means rotatably mounted on said frame and including a spiral recess formed therein for receiving and translating operating force applied thereto;

at least one handle means releasably secured to said camming means for receiving applied operating force and applying said force to said camming means to impart a rotary motion thereto; and cam means mounted on said insertion arms and cooperatively associated with and moving within the spiral recess formed in said camming means for receiving rotary force applied by said camming means and translating said applied force into force components applied to each of said insertion arms.

15. The apparatus of claim 14 wherein said roller means comprise needle bearings.

16. The apparatus of claim 14 wherein the spiral recess formed in said rotary camming means defines a path of travel for said roller means and wherein the angular relationship between the axis of said spiral recess and the axis of said roller means is greater during the time that the insertion tools carried by the insertion arms cut said insulated conductors than during the time that said insertion tools insert said conductors into the insulation-piercing contact portions of the connector.

17. An apparatus for terminating a plurality of insulated electrical conductors in respective insulation-piercing contact portions of an electrical connector, comprising:

a frame; means carried by the frame for supporting said connector and aligning said conductors adjacent respective insulation-piercing contact portions of said connector;

a pair of insertion arms rotatably mounted on said frame for movement toward respective sides of said connector, each of said arms carrying at least one insertion means for engaging and pressing respective insulated conductors into respective insulation-piercing contact portions of said connector;

actuator means responsive to an applied force for simultaneously applying sufficient operating force to each of said insertion arms to cut and insert said conductors into respective insulation-piercing contact portions of said connector; and means for controlling the extent of insertion of said insulated conductors into respective insulation-piercing contact portions of an electrical connector and for providing a positive indication of completion of insertion.

18. In an apparatus for terminating a plurality of insulated electrical conductors in respective insulation-piercing contact portions of an electrical connector, including a frame;

means carried by the frame for supporting said connector and aligning said conductors adjacent respective insulation-piercing contact portions of said connector;

a pair of insertion arms rotatably mounted on said frame for movement toward respective sides of said connector, each of said arms carrying a plurality of insertion means for engaging and pressing respective insulated conductors into respective insulation-piercing contact portions of said connectors;

the improvement comprising:

operating force application and translation means for applying operating force to said insertion arms and for translating said operating force into insertion force components sufficient to cut and insert said conductors into respective insulation-piercing contact portions of said connector, said operating force application and translation means including camming means rotatably mounted on said frame for receiving and translating operating forces applied thereto into insertion force components; and roller means mounted on said insertion arms and cooperatively associated with said camming means for receiving and transmitting said insertion force components to said insertion arms.

19. The apparatus of claim 18 wherein said camming means comprises a rotatable shaft including respective terminal ends and a spiral recess formed therein for engaging and defining a path of travel for said roller means.

20. The apparatus of claim 19 wherein said means for applying and translating operating force includes at least one handle means secured to a terminal end of said rotatable shaft for receiving applied operating force and applying said force to said rotatable shaft.

21. The apparatus of claim 20 wherein said handle means is releasably secured to a terminal end of said rotatable shaft and is independently positionable at differing points about the axis of rotation of said shaft to permit operating forces to be applied at differing angles and positions.

* * * * *